United States Patent [19]

Heisterberg

[11] 4,287,999

[45] Sep. 8, 1981

[54] SECONDARY SEAL FOR FLOATING ROOF STORAGE TANK

[75] Inventor: Milton W. Heisterberg, Flossmoor, Ill.

[73] Assignee: GATX Tank Erection Corporation, Chicago, Ill.

[21] Appl. No.: 151,786

[22] Filed: May 21, 1980

[51] Int. Cl.[3] ..... B65D 88/42

[52] U.S. Cl. ..... 220/222

[58] Field of Search ..... 220/221-224, 220/88 A, 88 R, 89 B, 226

[56] References Cited

U.S. PATENT DOCUMENTS

| | | | |
|---|---|---|---|
| 2,427,171 | 9/1947 | Wiggins | 220/222 |
| 2,540,801 | 2/1951 | Wiggins | 220/222 |
| 2,540,802 | 2/1951 | Wiggins | 220/222 |
| 2,754,026 | 7/1956 | Wiggins | 220/224 |
| 3,595,432 | 7/1971 | Heijden | 220/224 |
| 4,004,708 | 1/1977 | Boyd | 220/224 |

*Primary Examiner*—George T. Hall
*Attorney, Agent, or Firm*—Vogel, Dithmar, Stotland, Stratman & Levy

[57] ABSTRACT

A floating roof storage tank having an upstanding tank shell for containing liquid to be stored and having therein a floating roof floating on the surface of the stored liquid, a metal shoe carried by the floating roof and extending around the tank shell, a primary seal interconnecting the floating roof and the metal shoe, a plurality of seal support members shiftably mounted upon the metal shoe at the upper end thereof, a secondary seal extending between the upper rim of the floating roof and the seal support members and beyond the seal support members and against the inner surface of the tank shell; the seal support members are shiftable away from the tank shell a distance to permit inspection of the primary seal therebelow; limit structure acting between the metal shoe and the seal support members limit movement thereof to prevent the seal support members from contacting the tank shell.

15 Claims, 6 Drawing Figures

100
150
151
142
143
145
146
144
147
131
132
152
130
135
136
125
140
137
139
138
141
123
102
111
110
113
114
101
120
121
122
160
161
164

100
4.
150
151
145
142
147
152
161
160
164
123
125
136
137
138
139
140
141
131
130
135
111
120
121
122
101
102
110
113
103
114
116
115
112
119
118
106
117
157
158
107
153
162
154
155
156
105
108

SECONDARY SEAL FOR FLOATING ROOF STORAGE TANK

PRIOR ART STATEMENT AND BACKGROUND OF THE INVENTION

The present invention relates to improvements in secondary seals for floating roof storage tank, and specifically to the provision of a secondary seal that not only provides an additional seal between the tank shell and the floating roof rim, but also is constructed so that it can be retracted for inspection of the primary seal disposed therebeneath without disassembly of the secondary seal, and wherein the secondary seal includes structure limiting movement of the metal parts to ensure there is no metal-to-metal contact between the support structure for the secondary seal and the tank shell.

Current air quality control regulations require that floating roof storage tanks be provided with both a primary seal and a secondary seal to control the emission of volatile components and fumes from liquid stored within the floating roof storage tank. The primary seal covers the opening between the metal shoe sliding on the inner surface of the tank shell and the floating roof rim, while the separate secondary seal covers a space between the tank shell and the floating roof rim.

The secondary seal of the present invention meets the requirements of the current air quality regulations and is particularly adapted for use with a floating roof storage tank incorporating a metal shoe contacting the inner surface of the tank shell and being urged thereagainst by a pusher structure acting between the metal shoe and the floating roof. Examples of floating roof storage tanks in which the secondary seal of the present invention is useful are illustrated in U.S. Pat. No. 2,540,802 granted Feb. 6, 1951 to J. H. Wiggins, U.S. Pat. No. 2,754,026 granted July 10, 1956 to J. H. Wiggins and U.S. Pat. No. 2,802,591 granted Aug. 13, 1957 to J. H. Wiggins.

Secondary seals for floating roof storage tanks have been provided heretofore, and exemplars thereof are illustrated in U.S. Pat. No. 2,427,171 granted Sept. 9, 1947 to J. H. Wiggins and U.S. Pat. No. 2,540,801 granted Feb. 6, 1951 to J. H. Wiggins. The secondary seal illustrated in U.S. Pat. No. 2,427,171 cannot be readily retracted without disassembly in order to inspect the primary seal disposed therebeneath. The secondary seals in U.S. Pat. Nos. 2,427,171 and 2,540,801 are intimately associated with the primary seal and are not truly separate and independent with respect thereto; as a result, any malfunction or misalignment of the parts that would adversely affect the primary seal also would adversely affect the secondary seal.

BRIEF SUMMARY OF THE INVENTION

The present invention provides a secondary seal for floating roof storage tanks which is distinct and independent with respect to the primary seal, and therefore, provides a separate and independent seal between the tank shell and the rim of the floating roof.

The secondary seal of the present invention is also mounted and arranged such that the secondary seal can be retracted away from the tank shell without disassembly of the secondary seal or any other part of the storage tank, yet gives adequate room between the secondary seal and the tank shell for a clear inspection of the primary seal disposed therebeneath.

In addition, the metal parts of the structure supporting the secondary seal are arranged and include limit structure so that there is no possibility of metal-to-metal contact between any part of the structure supporting the secondary seal and the tank shell.

This is accomplished in the present invention, and it is an object of the present invention to accomplish these desired results, by providing a floating roof storage tank including an upstanding cylindrical tank shell for containing a quantity of liquid to be stored, a floating roof within the tank shell and adapted to float on the surface of the liquid within the tank shell, a circular metal shoe encircling the floating roof and slidably engaging the inner surface of the tank shell, a sealing member extending between the floating roof and the metal shoe enclosing the space therebetween to provide a primary seal therebetween, a plurality of seal support members shiftably mounted upon the metal shoe adjacent to the upper end thereof and shiftable toward and away from the associated tank shell, and flexible means extending between the floating roof and the seal support members and secured thereto and extending beyond the seal support members and lying in sealing engagement with the inner surface of the tank shell to form a secondary seal between the floating roof and the tank shell, the seal support members being shiftable toward and away from the tank shell to accommodate variations in position of the floating roof with respect to the tank shell and being shiftable away from the tank shell to move the flexible means out of contact with the tank shell a distance to permit inspection of the primary seal.

Another object of the invention is to provide a support bar mounted on the metal shoe and extending around the tank shell, the seal support means each having a slot therein in which the support bar is engaged so as to accommodate shifting of the seal support members and a portion of the flexible means attached thereto toward and away from the metal shoe, each of the slots preferably having the longitudinal axis thereof extending upwardly and inwardly with respect to the tank shell.

Yet another object of the invention is to provide a floating roof storage tank of the type set forth wherein there is provided a plurality of anti-sag strips mounted on the floating roof and extending upwardly and outwardly therefrom and underlying the flexible means forming the secondary seal to support the same.

Still another objection of the invention is to provide a floating roof storage tank of the type set forth including limit means acting between the metal shoe and the seal support members to limit the shifting of the seal support members toward and away from the metal shoe and the tank shell to prevent contact of the seal support members with the tank shell.

A further object of the invention is to provide a floating roof storage tank of the type set forth wherein a wiper member is mounted on the seal support members and extends outwardly therefrom and engages the inner surface of the tank shell to form a further secondary seal therewith, the wiper member preferably being disposed above the flexible means, to insure that one of the wiper member and the flexible means is always in contact with the tank shell and not riding on a rivet head.

Further features of the invention pertain to the particular arrangement of the parts of the secondary seal for the floating roof storage tank, whereby the above outlined and additional operating features thereof are attained.

The invention, both as to its organization and method of operation, together with further features and advantages thereof will best be understood with reference to the following specification taken in connection with the accompanying drawings.

DETAILED DESCRIPTION OF THE PREFERRED EMBODIMENTS

Figure 2:
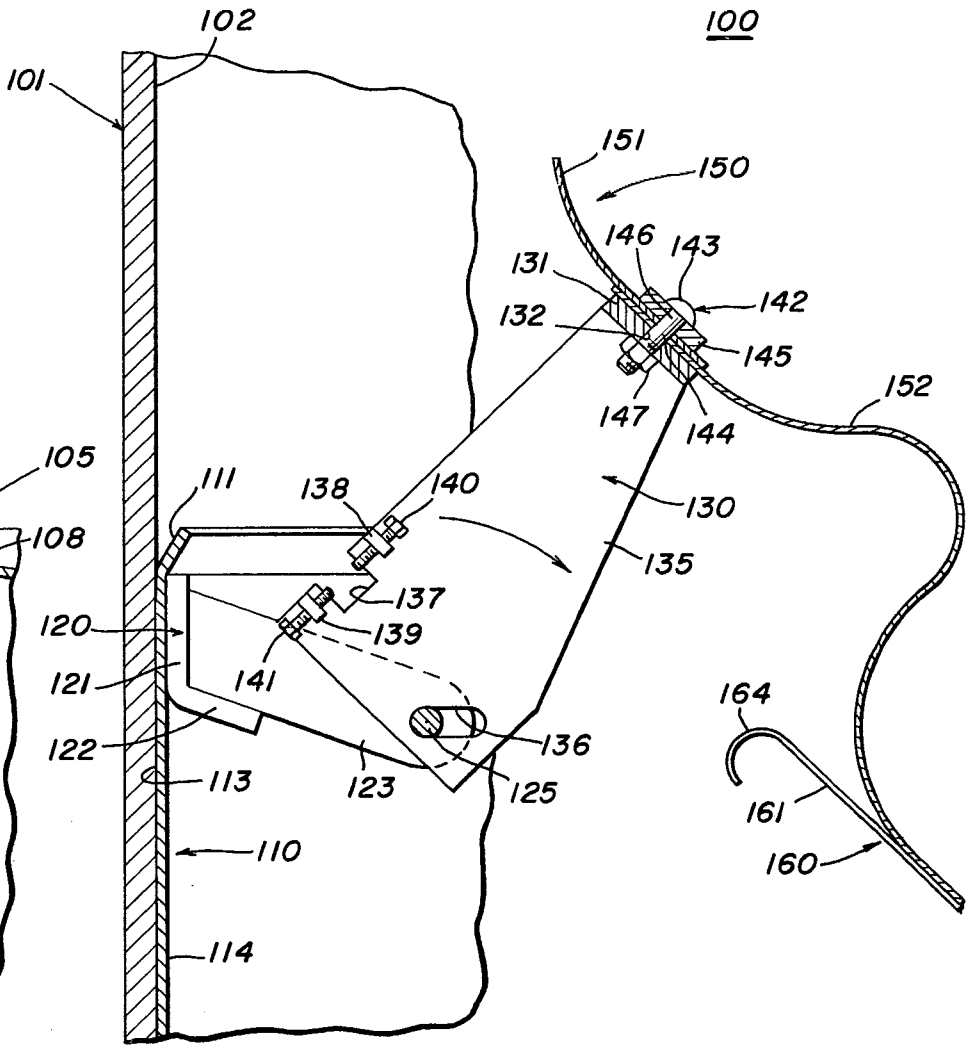
FIG. 2 is an enlarged view in vertical section like FIG. 1, but showing the parts of the secondary seal in the retracted position that permits inspection of the primary seal therebelow.

Referring to FIGS. 1 to 4 of the drawings, there is illustrated a floating roof storage tank 100 incorporating therein a primary seal 115 and a secondary seal 150, the secondary seal 150 being made in accordance with and embodying the principles of the present invention.

The floating roof storage tank 100 includes the usual upright cylindrical tank shell 101 that is circular in horizontal cross section and has an inner surface 102 against which the liquid stored is in contact. Such storage tanks are widely used to hold petroleum and petroleum products, such as gasoline, as well as other volatile liquids. Disposed within the tank shell 101 and spaced radially inwardly from the inner surface 102 thereof and adapted to float on the surface of the liquid within the tank shell 101 is a floating roof or pontoon 105. The floating roof 105 is a hollow structure having an outer wall 106 with an upper edge or rim 107, the wall 106 being circular in horizontal section and being spaced away from the tank shell 101. The bottom of the outer wall 106 is closed by a bottom wall (not shown) and a top wall or cover plate 108 closes the top of the outer wall 106. The tank shell 101 and the floating roof 105 are normally made of metal, such as steel.

A metal shoe 110 is disposed within the tank shell 101 and slidably engages the inner surface 102 of the tank shell 101. The metal shoe 110 is provided with a circumferentially extensible and contractable expansion joint (not shown) whereby the metal shoe 110 can be kept in close contact with the tank shell 101 at all relative positions therebetween. The upper edge of the metal shoe 110 has an inwardly and upwardly directed upper flange 111 extending therearound, and the lower edge of the metal shoe 110 has an inwardly and downwardly directed lower flange 112 extending therearound. The metal shoe 110 is also provided with an outer surface 113 that bears against the inner surface 102 of the tank shell 101, and also has an inner surface 114. The primary seal 115 is provided between the floating roof 105 and the metal shoe 110 in the form of a flexible sealing member which has the outer edge thereof secured by clamps 116 to the inner surface 114 of the metal shoe 110 and has the inner edge thereof secured by clamps 117 to the outer surface of the floating roof wall 106. The metal shoe 110 is carried by and moves upwardly and downwardly with the floating roof 105, pusher structure being provided interconnecting the floating roof 105 and the metal shoe 110 and including a piston cylinder 118 mounted on the floating roof 105 and a piston rod 119 extending therefrom and secured by a bracket 103 to the inner surface 114 of the metal shoe 110. A plurality of the pusher structures, each including the piston cylinder 118 and piston rod 119, is provided around the circumference of the floating roof 105 and acts between the floating roof 105 and the metal shoe 110 to provide proper alignment therebetween and to ensure the proper positioning of the floating roof 105 with respect to the metal shoe 110. Details of the construction and operation of the pusher structure are set forth in U.S. Pat. No. 2,802,591 referred to above.

The secondary seal 150 has the inner edge thereof attached to the upper rim 107 on the floating roof 105 and the outer edge thereof supported by the metal shoe 110. There is provided on the inner surface 114 of the metal shoe 110 below the upper flange 111 thereof a plurality of weatherhood castings 120 (see FIGS. 3 and 4 also), each of which has a curved elongated body 121 secured to the metal shoe 110 and having extending inwardly and downwardly from the lower edge thereof a flange 122 that extends the length thereof. An arm 123 extends inwardly and downwardly from essentially the center of each of the castings 120 and the arms 123 collectively securing and supporting a support bar 125 that extends around the storage tank 100, the support bar 125 having a circular cross section. A plurality of seal support members in the form of wiper clamp rockers 130 are pivotally mounted upon the support bar 125 around the circumference of the storage tank 100. Each of the rockers 130 includes a clamping bar 131 (see particularly FIG. 3 also) having openings 132 therein that receive fasteners to secure the secondary seal 150 thereto. Each of the bars 131 has two mounting arms 135 extending downwardly therefrom, and each of the arms 135 has an elongated slot 136 therein, the axis of each slot 136 being disposed extending upwardly and inwardly with respect to the tank shell 101 when the secondary seal 150 is in the sealing position thereof. The support bar 125 extends through the elongated slots 136 to mount the arms 135 thereon and thus to mount the rockers 130 for shiftable movement toward and away from the tank shell 101. Each of the arms 135 has a notch 137 in the edge thereof disposed toward the tank shell 101 and threaded bosses 138 and 139 are disposed respectively above and below the notch 137, the threaded bosses 138 and 139 receiving abutment screws 140 and 141 respectively which provide limit means to limit the movement of the rockers 130. More specifically, the adjacent ends of the screws 140 and 141 are disposed on opposite sides of the associated flange 122 of the casting 120, and by threadedly positioning the screws 140 and 141 with respect to the associated bosses 138 and 139, the amount of shifting of the rocker 130 with respect to the metal shoe 110 can be adjusted so as to ensure that the rockers 130 cannot come into contact with the tank shell 101.

The secondary seal 150 comprises a flexible means or member, and as illustrated the secondary seal is divided into two parts, each of which extends completely around the inner periphery of the tank shell 101, one being a joiner seal member 152 that extends from the floating roof rim 107 to the clamping bars 131, and the other being a wiper member 151 that extends outwardly radially from the clamping bars 131 and wipingly engages the inner surface 102 of the tank shell 101. The inner edge of the wiper member 151 and the outer edge of the joiner seal member 152 are clamped to the upper surface of the clamping bar 131. More specifically, clamping plates 145 are disposed thereabove and bolts 142 extend through aligned apertures therein, the bolts 142 having heads 143 engaging the upper surfaces of the clamping plates 145 and having shanks 144 through the aligned apertures including openings 146 in the clamping plates 145, nuts 147 engaging the threaded shanks 144 so as to clamp the adjacent edges of the members 151 and 152 between the clamping bars 131 and clamping plates 145 (see FIG. 2 particularly).

Figure 1:
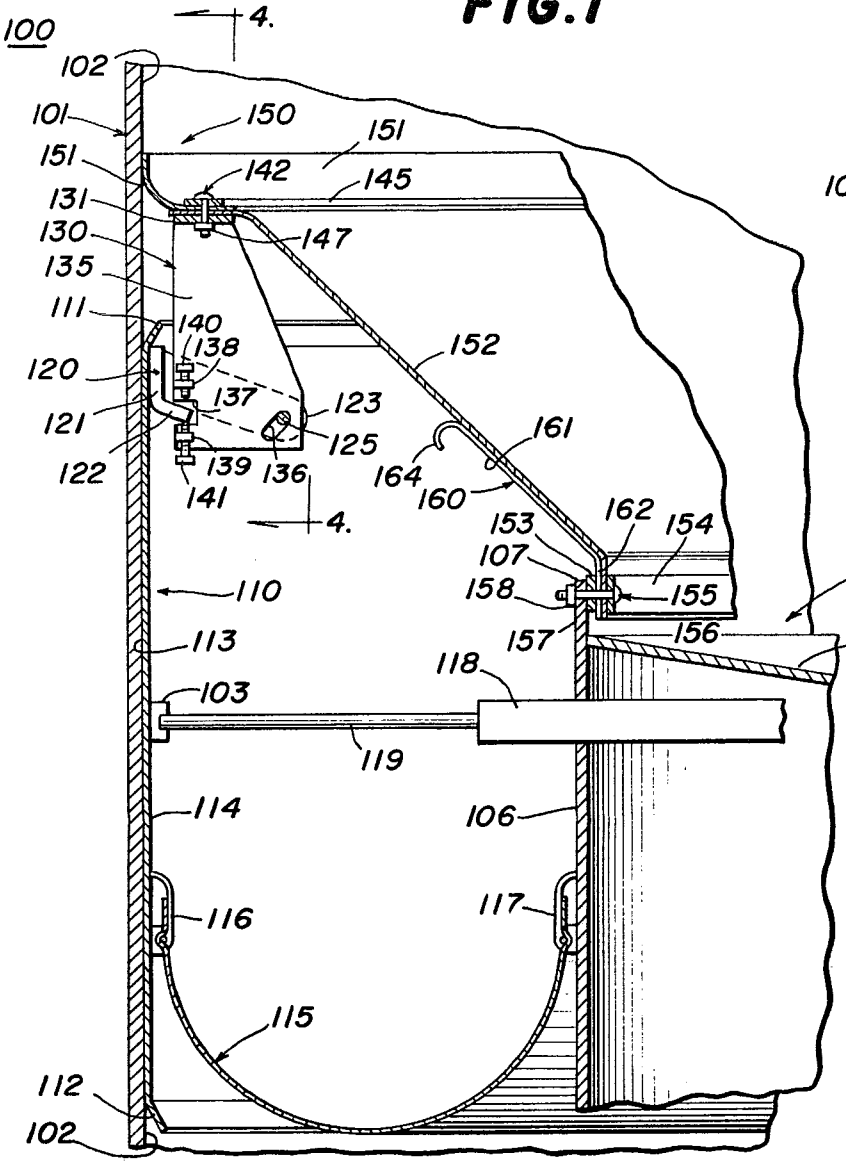
FIG. 1 is a fragmentary vertical section through the tank shell, floating roof, primary seal and secondary seal of a storage tank incorporating therein a secondary seal made in accordance with and embodying the principles of the present invention, the parts being illustrated in the position wherein the secondary seal is engaging the tank shell.
Figure 3:
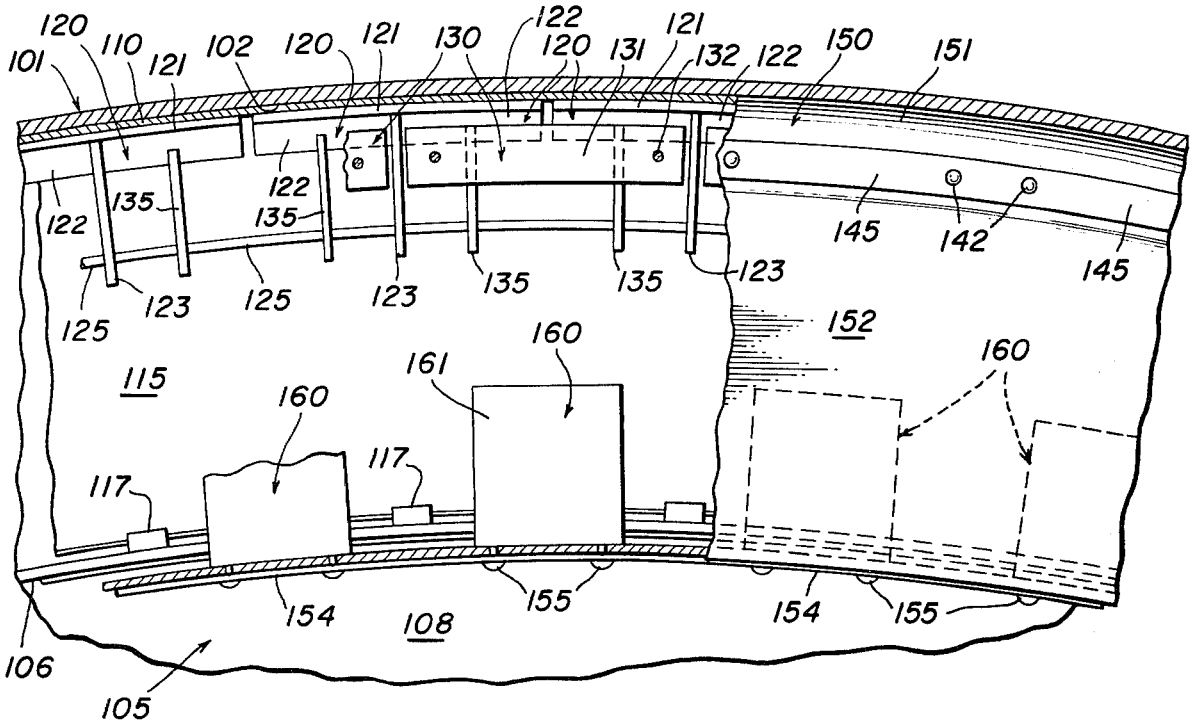
FIG. 3 is a fragmentary view in horizontal section showing the construction of the primary seal and the secondary seal of FIGS. 1 and 2.
Figure 4:
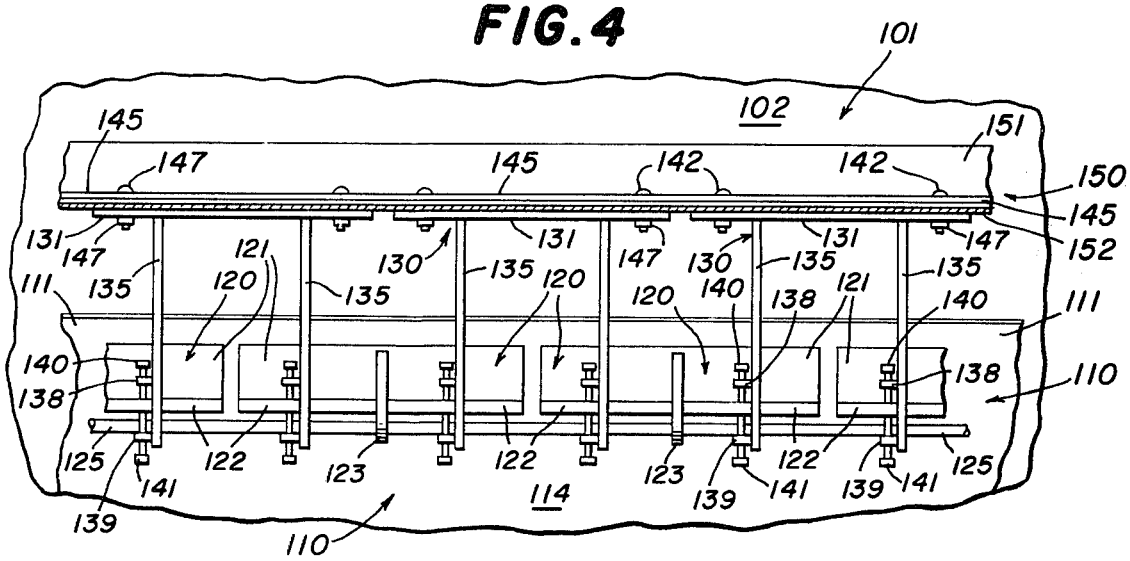
FIG. 4 is a fragmentary view in vertical section along the line 4—4 of FIG. 1.

The inner edge of the joiner seal member 152 in the form of the invention illustrated in FIGS. 1 to 4 of the drawings is secured to the inner side of the floating roof rim 107, see particularly FIG. 1. There is provided a resilient sealant 153 extending around the inner surface of the rim 107 and a plurality of clamp bars 154 disposed inwardly with respect to the sealant member 153 and used to clamp the adjacent edge of the joiner seal member 152. To this end a plurality of aligned openings is provided through the parts to receive bolts 155 each having a head 156 engaging the inner surface of the associated clamp bar 154 and having a shank 157 extending through the aligned openings and outwardly beyond the rim 107 and receiving a nut 158 to clamp the parts together.

There further are provided around the periphery of the floating roof 105 a plurality of anti-sag strips 160 each including an elongated body 161 having at one end a mounting flange 162 making an obtuse angle with respect to the body 161 and having at the other end a curved end 164 (see FIG. 1 particularly). The mounting flange 162 has an opening therethrough which receives one of the shanks 157 of the bolts 155 so that the anti-sag strips 160 are held in the upwardly and outwardly extending position illustrated in FIG. 1. The anti-sag strips 160 serve to hold the secondary seal 150, and particularly the joiner seal member 152, out of contact with the pusher structure of the piston cylinder 118 and the piston rod 119, as well as all other parts disposed between the floating roof 105 and the metal shoe 110.

Referring particularly to FIG. 1 of the drawings, the parts are there shown in a position such that the secondary seal 150 is in its operative position to provide an additional seal between the upper end of the floating roof 105 and the inner surface 102 of the tank shell 101, all so as to satisfy the current air quality control regulations. More specifically, the wiper member 151 of the secondary seal 150 is pressed against the surface 102 of the tank shell 101 and is held in that position by its mounting structure including the rockers 130. Movement of the rockers 130 about the support bar 125 is limited by the positions of the adjacent ends of the abutment screws 140 and 141 which engage the flange 122. This serves to hold the wiper member 151 in the proper engaged position with the tank shell 101 and also serves to prevent any metal-to-metal contact between the support structure for the secondary seal 150 and the tank shell 101. As illustrated, the secondary seal 150 rises and falls with the floating roof 105, it being understood that the metal shoe 110 also rises and falls with the floating roof 105 whereby the wiper member 151 of the secondary seal 150 is carried upwardly and downwardly with the metal shoe 110.

When it is desired to inspect the primary seal 115 or to provide maintenance on the secondary seal 150, the rockers 130 are moved from the position illustrated in FIG. 1 to the position illustrated in FIG. 2. More specifically, the lower ends of at least a portion of the rockers 130 are moved upwardly and inwardly, such movement being accommodated by the slot 136 engaging the support bar 125. This movement disengages the abutment screws 140 and 141 from their abutting positions with respect to the flange 122 and permits the entire rocker 130 and attached parts to be pivoted to the position illustrated in FIG. 2, i.e., clockwise and inwardly as there illustrated. Such movement of the rockers 130 moves the associated section of the wiper member 151 well away from the inner surface 102 of the tank shell 101 and provides an uninterrupted and unimpeded view of the primary seal 115 and the mounting therefor. This also permits inspection of the pusher structure including the piston cylinder 118 and the piston rod 119, as well as any maintenance and repair on the secondary seal 150 and the various parts thereof.

Figure 5:
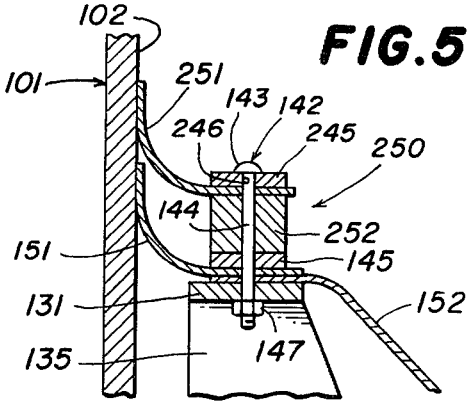
FIG. 5 is a second embodiment of the invention wherein a second secondary seal is mounted above the first secondary seal.

There is illustrated in FIG. 5 of the drawings, a second embodiment of the invention wherein the secondary seal 250 has added thereto a second wiper member 251. The construction there illustrated is identical to that described with respect to FIGS. 1 to 4 above, except that the shank 144 of the bolt 142 has been elongated and there has been positioned on top of the clamping plate 145 a spacer 252. On top of the spacer 252 there has been placed the annular wiper member 251 which is constructed and arranged as is the wiper member 151. On top of the second wiper member 251 and below the bolt head 143 is disposed a second clamping plate 245 having an opening 246 therethrough to receive the shank 144. The provision of the second wiper member 251 assists in maintaining a good seal with the inner surface 102 of the tank shell 101.

Figure 6:
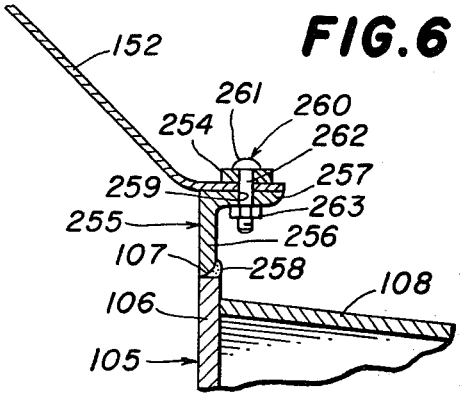
FIG. 6 is a fragmentary view in vertical section showing the connection between the inner portion of the secondary seal and the rim of the floating roof, there being illustrated a modified form of the support.

There is illustrated in FIG. 6 of the drawings an alternative manner of connecting the inner edge of the joiner seal member 152 to the rim 107 of the floating roof 105. There has been provided an angle iron 255 formed by two normally disposed flanges 256 and 257, the free edge of the flange 256 resting upon the upper edge of the rim 107 and being secured thereto as by welding at 258. The other flange 257 extends inwardly from the upper edge of the flange 256 and supports thereon the inner edge of the joiner seal member 152 and also supports a clamp bar 254 resting on top of the adjacent edge of the joiner seal member 152. The flange 257 and the adjacent edge of the joiner seal member 152 and the clamp bar 254 have aligned openings therethrough receiving a bolt 260, and specifically the shank 262 thereof, the head 261 resting upon the upper surface of the clamp bar 254 and a nut 263 threadedly engaging the lower threaded ends of the shank 262. It will be understood that a plurality of the clamp bars 254 is provided and likewise a plurality of the bolts 260 and nuts 263 is provided so as to clamp the adjacent edge of the joiner seal member 152 around the entire periphery thereof.

It is to be understood that the constructions illustrated in FIGS. 5 and 6 of the drawings possess all the fundamental desirable characteristics and properties illustrated in and described above with respect to FIGS. 1 to 4 of the drawings.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A floating roof storage tank comprising an upstanding cylindrical tank shell for containing a quantity of liquid to be stored, a floating roof within said tank shell and adapted to float on the surface of the liquid within said tank shell, a circular metal shoe encircling said floating roof and slidably engaging the inner surface of said tank shell, pusher structure mounting said metal shoe upon said floating roof and urging said metal shoe into sealing contact with the inner surface of said tank shell, a sealing member extending between said floating roof and said metal shoe and closing the space therebetween to provide a primary seal therebetween, a plurality of seal support members shiftably mounted upon said metal shoe adjacent to the upper end thereof and shiftable toward and away from the associated tank shell, and flexible means extending between said floating roof and said seal support members and secured thereto and extending beyond said seal support members and lying in sealing engagement with the inner surface of said tank shell to form a secondary seal between said floating roof and said tank shell, said seal support members being shiftable toward and away from said tank shell to accommodate variations in position of said floating roof with respect to said tank shell and being shiftable away from said tank shell to move said flexible means out of contact with said tank shell a distance to permit inspection of the primary seal.

2. The floating roof storage tank set forth in claim 1, and further comprising a support bar mounted on said metal shoe and extending around the tank shell, said seal support members each having a slot therein in which said support bar is engaged so as to accommodate shifting of said seal support members and the portion of the flexible means attached thereto toward and away from said metal shoe.

3. The floating roof storage tank set forth in claim 2, wherein each of said slots has the longitudinal axis thereof extending upwardly and inwardly with respect to said tank shell.

4. The floating roof storage tank set forth in claim 1, wherein said flexible means is formed as two portions, the first portion of said flexible means extending between said floating roof and said seal support members, and the second portion of said flexible means extending from said seal support members outwardly to engage the inner surface of said tank shell.

5. The floating roof storage tank set forth in claim 1, and further comprising a plurality of anti-sag strips mounted on said floating roof and extending upwardly and outwardly therefrom and underlying the flexible means for supporting the same.

6. The floating roof storage tank set forth in claim 1, wherein said floating roof has an upstanding outer rim extending therearound, and the inner edge of said flexible means is connected to said floating roof on the inside of said outer rim.

7. The floating roof storage tank set forth in claim 1, wherein said floating roof has an upstanding outer rim extending therearound, and the inner edge of said flexible means is connected to said floating roof on top of said outer rim.

8. A floating roof storage tank comprising an upstanding cylindrical tank shell for containing a quantity of liquid to be stored, a floating roof within said tank shell and adapted to float on the surface of the liquid within said tank shell, a circular metal shoe encircling said floating roof and slidably engaging the inner surface of said tank shell, pusher structure mounting said metal shoe upon said floating roof and urging said metal shoe into sealing contact with the inner surface of said tank shell, a sealing member extending between said floating roof and said metal shoe and closing the space therebetween to provide a primary seal therebetween, a plurality of seal support members shiftably mounted upon said metal shoe adjacent to the upper end thereof and shiftable toward and away from the associated tank shell, limit means acting between said metal shoe and said seal support members to limit the shifting of said seal support members toward and away from said metal shoe and said tank shell to prevent contact of said seal support members therewith, and flexible means extending between said floating roof and said seal support members and secured thereto and extending beyond said seal support members and lying in sealing engagement with the inner surface of said tank shell to form a secondary seal between said floating roof and said tank shell, said seal support members being shiftable toward and away from said tank shell to accommodate variations in position of said floating roof with respect to said tank shell and being shiftable away from said tank shell to disengage said limit means and to move said flexible means out of contact with said tank shell a distance to permit inspection of the primary seal.

9. The floating roof storage tank set forth in claim 8, wherein said limit means is adjustable so as to adjust the amount of movement between said metal shoe and said seal support members.

10. The floating roof storage tank set forth in claim 8 and further comprising a flange mounted on said metal shoe and extending inwardly therefrom, two spaced-apart abutments on said seal support members and adapted to receive said flange therebetween and thus to limit the movement of said seal support members with respect to said metal shoe and said tank shell.

11. The floating roof storage tank set forth in claim 10, wherein said abutments are screws threadedly mounted on said seal support members and being threadedly adjustable toward and away from each other.

12. The floating roof storage tank set forth in claim 8, and further comprising a support bar mounted on said metal shoe and extending therearound, each of said seal support members having an elongated slot therein receiving said support bar therethrough for shiftably mounting said seal support members upon said support bar, said slots permitting shifting of said seal support members away from said metal shoe to disengage said limit means.

13. A floating roof storage tank comprising an upstanding cylindrical tank shell for containing a quantity of liquid to be stored, a floating roof within said tank shell and adapted to float on the surface of the liquid within said tank shell, a circular metal shoe encircling said floating roof and slidably engaging the inner surface of said tank shell, pusher structure mounting said metal shoe upon said floating roof and urging said metal shoe into sealing contact with the inner surface of said tank shell, a sealing member extending between said floating roof and said metal shoe and closing the space therebetween to provide a primary seal therebetween, a plurality of seal support members shiftably mounted upon said metal shoe adjacent to the upper end thereof and shiftable toward and away from the associated tank shell, flexible means extending between said floating roof and said seal support members and secured thereto and extending beyond said seal support members and lying in sealing engagement with the inner surface of said tank shell to form a secondary seal between said floating roof and said tank shell, and a wiper member mounted on said seal support member and extending outwardly therefrom and engaging the inner surface of said tank shell to form another secondary seal therewith, said seal support members being shiftable toward and away from said tank shell to accommodate variations in position of said floating roof with respect to said tank shell and being shiftable away from said tank shell to move said flexible means and said wiper member out of contact with said tank shell a distance to permit inspection of the primary seal.

14. The floating roof storage tank set forth in claim 13, wherein said flexible means is formed as two portions, a first portion of said flexible means extending between said floating roof and said seal support members, and the second portion of said flexible means extending from said seal support members outwardly to engage the inner surface of said tank shell, said second portion and said wiper member both engaging the inner surface of said tank shell one above the other to provide the secondary seal.

15. The floating roof storage tank set forth in claim 13, wherein said wiper member is disposed above said flexible means.

* * * * *